US006076868A

United States Patent [19]

Roger, Jr. et al.

[11] Patent Number: 6,076,868

[45] Date of Patent: Jun. 20, 2000

[54] VEHICLE COMPARTMENT LATCH

[75] Inventors: Lloyd Walker Roger, Jr., Macomb County; Neil Mork, Armada; Reginald Leo Mc Donald, Macomb County, all of Mich.

[73] Assignee: General Motors Corporation, Detroit, Mich.

[21] Appl. No.: 09/247,387

[22] Filed: Feb. 9, 1999

[51] Int. Cl.[7] ..... E05C 3/06

[52] U.S. Cl. ..... 292/201; 292/DIG. 23; 292/199; 292/216

[58] Field of Search ..... 292/201, DIG. 23, 292/216, DIG. 43, 199, 280

[56] References Cited

U.S. PATENT DOCUMENTS

| | | | |
|---|---|---|---|
| 2,896,990 | 7/1959 | Garvey et al. | 292/201 |
| 4,518,180 | 5/1985 | Kleefeldt et al. | 292/201 |
| 4,588,217 | 5/1986 | Escaravage | 292/201 |
| 4,652,027 | 3/1987 | Quantz | 292/201 |
| 4,667,991 | 5/1987 | Pebre | 292/201 |
| 4,904,006 | 2/1990 | Hayakawa et al. | 292/336.3 |
| 5,066,054 | 11/1991 | Ingenhoven | 292/201 |
| 5,921,594 | 7/1999 | Bendel | 292/216 |
| 5,934,717 | 8/1999 | Wirths et al. | 292/201 |

*Primary Examiner*—B. Dayoan
*Assistant Examiner*—John B. Walsh
*Attorney, Agent, or Firm*—Kathryn A. Marra

[57] ABSTRACT

A vehicle closure has a power operated compartment latch that includes a stop lever and an eccentric roller on an electric motor driven wheel. The stop lever is moved to a by-pass position automatically cocking the compartment latch when the compartment latch is latched. The eccentric roller then by-passes the stop lever and unlatches the compartment latch when the electric motor is energized. The stop lever is moved to a stop position when the compartment latch is unlatched to automatically reset the compartment latch.

3 Claims, 2 Drawing Sheets

VEHICLE COMPARTMENT LATCH

TECHNICAL FIELD

This invention relates to a vehicle compartment latch and more particularly to a power operated latch for latching a vehicle compartment closure, such as a trunk deck lid or a cargo lift gate, in the closed position to secure the vehicle compartment.

BACKGROUND OF THE INVENTION

Passenger vehicles are normally equipped with a rear vehicle compartment for storing a spare tire and transporting items such as groceries and luggage. A conventional passenger vehicle has a trunk that is closed by a deck lid that is hinged to the vehicle body and swings open to provide access to the trunk. On the other hand, a passenger van has a rear cargo compartment that is closed by a lift gate. The deck lid or lift gate is usually equipped with a compartment latch that cooperates with a striker attached to the vehicle body to latch the closure (e.g. deck lid or lift gate) in the closed position.

In order to open the vehicle closure, the compartment latch must be unlatched or opened. Nearly all installations include a key lock cylinder or some other means for unlatching the compartment latch manually. However, power compartment latches that can be unlatched electrically by a switch inside the passenger compartment or by a key fob are becoming very popular.

In the past, power compartment latches have required either a reversible electric motor or a massive return spring to restore the compartment latch to an open position after a power unlatching operation.

SUMMARY OF THE INVENTION

The object of the invention is to provide an improved vehicle compartment latch that does not require either a reversible electric motor or a massive return spring to restore the compartment latch to an open position.

A feature of the invention is that the vehicle compartment latch is powered by a unidirectional electric motor.

Another feature of the invention is that the vehicle compartment latch is unlatched by a unidirectional electric motor that is shut off by stalling the electric motor.

Another feature of the invention is that the vehicle compartment latch is automatically cocked for a power unlatching operation when the compartment latch is latched.

Still another feature of the invention is that the vehicle compartment latch is automatically reset when the compartment latch is unlatched.

These and other objects, features and advantages of the invention will become more apparent from the following description of a preferred embodiment taken in conjunction with the accompanying drawing.

BRIEF DESCRIPTION OF THE DRAWINGS

The presently preferred embodiment of the invention is disclosed in the following description and in the accompanying drawings, wherein.

DETAILED DESCRIPTION OF THE PREFERRED EMBODIMENT

Figure 1:
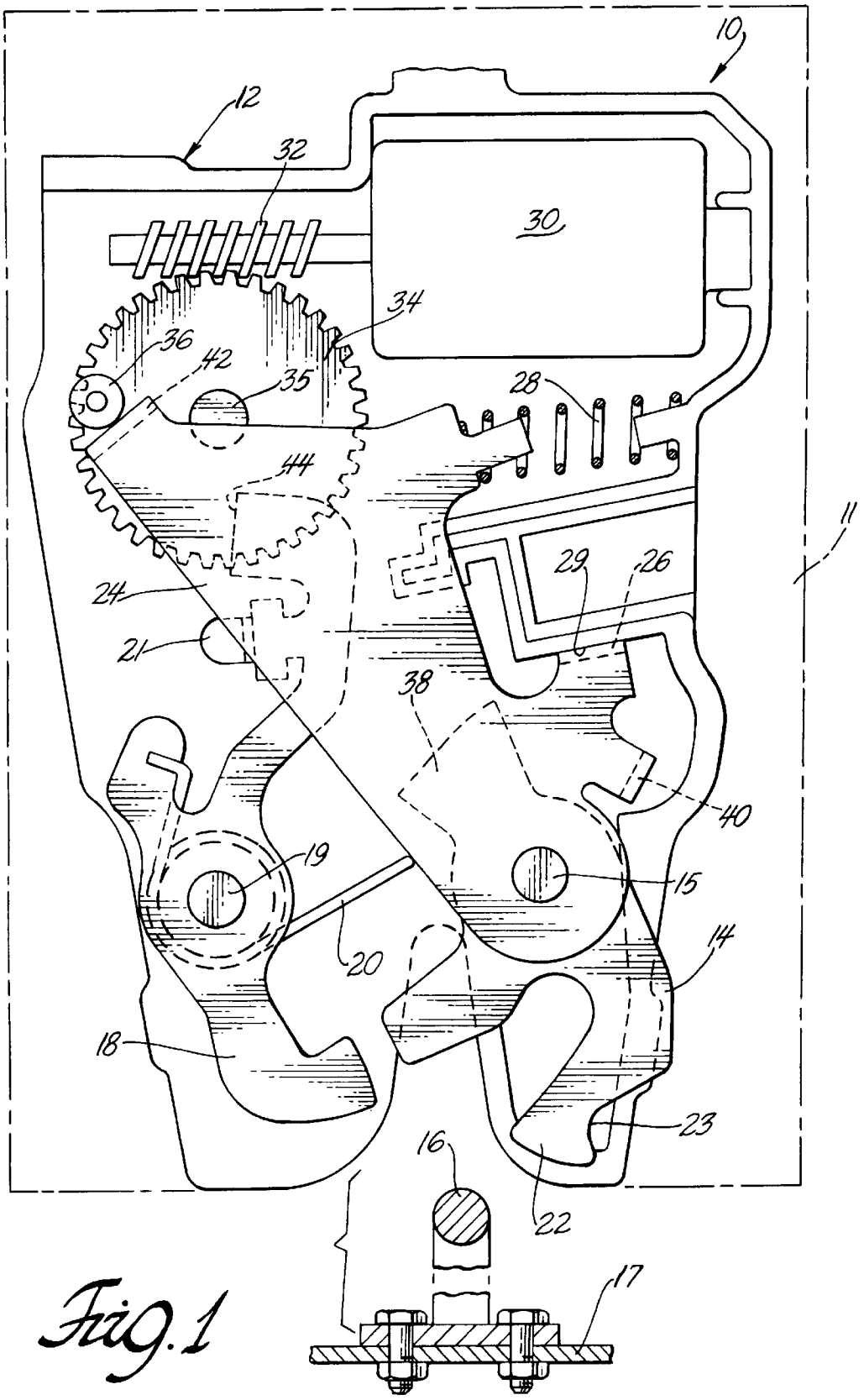
FIG. 1 is a rear view of a vehicle having a closure that is equipped with a vehicle compartment latch of the invention showing the parts of the vehicle compartment latch in the open or unlatched position.
Figure 2:
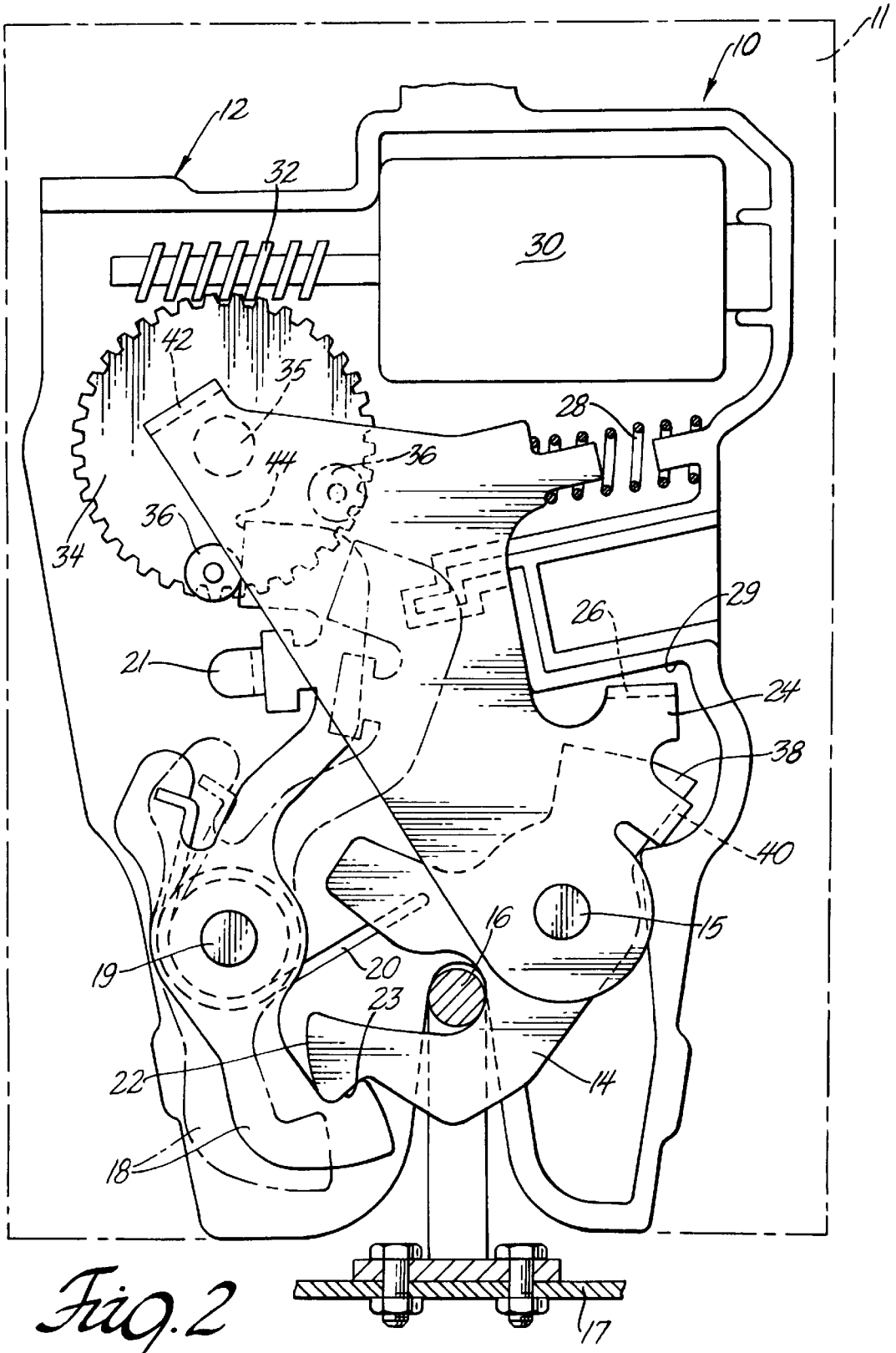
FIG. 2 is a rear view of the vehicle of FIG. 1 showing the parts of the vehicle closure latch in the closed or latched position.

Vehicle compartment latch 10 comprises a housing or support 12 that is adapted for fastening to a vehicle compartment closure, such as a trunk compartment deck lid 11 and a fork bolt 14 that pivots on support 12 about pivot pin 15 between an open or unlatched position shown in FIG. 1 and a closed or latched position shown in FIG. 2. Vehicle compartment latch 10 is attached to deck lid 11 so that fork bolt 14 is moved from the open position shown in FIG. 1 to the closed position shown in FIG. 2 when deck lid 11 is closed and fork bolt 14 engages a striker 16 that is attached to the vehicle body 17 at the deck lid opening. The cooperation of a fork bolt and striker is well known and need not be described in detail.

Vehicle compartment latch 10 further comprises a detent lever 18 that pivots on support 12 about pivot pin 19 and cooperates with fork bolt 14 in a well known manner to retain fork bolt 14 in the closed position shown in FIG. 2 or release the fork bolt 14 for return to the open position shown in FIG. 1. That is, detent lever 18 pivots between a detent position shown in solid line in FIGS. 1 and 2 and a release position shown in dashed line in FIG. 2. Fork bolt 14 is spring biased counterclockwise to the open position shown in FIG. 1 by a suitable return spring (not shown). Detent lever 18 is also spring biased counterclockwise by spring 20 against abutment 21 of support 12 to the detent position shown in solid line in FIGS. 1 and 2 so that detent lever 18 rides over end 22 of fork bolt 14 and engages latch shoulder 23 of fork bolt 14 when fork bolt 14 is moved to the closed position by closing deck lid 11.

Vehicle compartment latch 10 further comprises a stop lever 24 that also pivots on support 12 about the pin 15 for fork bolt 14. Coil spring 28 biases stop lever 24 counterclockwise to a stop position where ear 26 abuts an abutment 29 of support 12 as shown in FIG. 1.

Vehicle compartment latch 10 includes a unidirectional electric motor 30 mounted on support 12. Motor 30 drives a worm gear 32 that in turn drives a gear wheel 34 that rotates on pivot pin 35 of support 12. Gear wheel 34 carnes an eccentric roller 36 that moves in a circular path as gear wheel 34 rotates on pivot pin 35. Roller 36 cooperates with detent lever 18 and stop lever 24 as explained below.

Vehicle compartment latch 10 operates in the following manner. When deck lid 11 is closed, fork bolt 14 engages striker 16 and fork bolt 14 is pivoted clockwise by the closing deck lid 11 from the open or unlatched position shown in FIG. 1 to the closed or latched position trapping striker 16 in the compartment latch 10 as shown in FIG. 2. As fork bolt 14 pivots to the closed position, tab 38 of fork bolt 14 engages tab 40 of stop lever 24 pivoting stop level 24 clockwise from the stop position shown in FIG. 1 to a by-pass position shown in FIG. 2. This compresses spring 28 and moves stop tab 42 of stop lever 24 toward the axis of gear wheel 34 and out of the circular travel path of eccentric roller 36. Thus, vehicle compartment latch 10 is automatically cocked for a power release or unlatching operation upon latching.

Vehicle compartment latch 10 is power released by energizing motor 30 which turns gear wheel 34 counterclockwise so that roller 36 travels counterclockwise in a circular path from the position shown in FIG. 1 to the position shown in FIG. 2, by-passing stop tab 42 and into engagement with cam surface 44 of detent lever 18. As gear wheel 34 continues turning, roller 36 pivots detent lever 18 clockwise to the release position shown in dashed line in FIG. 2.

Fork bolt 14 is now free to rotate counterclockwise and deck lid 11 is opened a given amount by the bias of the fork bolt return spring (not shown) and the pressure of the deck lid seal (not shown). These opening forces open deck lid 11 enough to withdraw striker 16 so that fork bolt 14 pivots counterclockwise back to the open position shown in FIG. 1 under the bias of the fork bolt return spring. As fork bolt 14 rotates counterclockwise to the open position, tab 38 moves away from tab 40 and thus stop lever 24 also rotates counterclockwise under the bias of coil spring 28 to the stop position shown in FIG. 1. In the meantime, roller 36 continues to travel with gear wheel 34 past cam surface 44 and back around to eventually engage stop tab 42 of stop lever 24 and stall electric motor 30. The parts are now in the position shown in FIG. 1 and thus vehicle compartment latch 10 is automatically reset for latching engagement with striker 16 when deck lid 11 is closed.

While the compartment latch of our invention has been described in connection with deck lid 11, the compartment latch can be used with other compartment closures such as a van lift gate. In other words, many modifications and variations of the present invention in light of the above teachings may be made. It is, therefore, to be understood that, within the scope of the appended claims, the invention may be practiced otherwise than as specifically described.

We claim:

1. A power operated vehicle compartment latch comprising:

a support that is adapted for fastening to a closure, a fork bolt that moves between an open position and a closed position, a detent lever that moves between a detent position and a release position, the detent lever retaining the fork bolt in the closed position when in the detent position and releasing the fork bolt for return to the open position when in the release position, a one-piece stop lever that moves between a stop position and a by-pass position, a motor mounted on the support, a wheel that rotates on the support and that is driven by the motor, the wheel carrying an eccentric member that moves in a circular path as the wheel rotates, the fork bolt moving the stop lever from the stop position to the by-pass position when the fork bolt is moved from the open position to the closed position so as to move a stop tab of the stop lever out of the path of travel of the eccentric member, so that the eccentric member bypasses the stop tab and moves the detent lever to the release position when the fork bolt is in the closed position and the motor is energized to unlatch the compartment latch, and the stop lever returning to the stop position when the compartment latch is unlatched so that the stop tab is engaged by the eccentric member to stall the motor.

2. A power operated vehicle compartment latch comprising:

a support that is adapted for fastening to a vehicle closure, a fork bolt that pivots on the support between an open position and a closed position, the fork bolt being moved from the open position to the closed position when the vehicle closure is closed, a detent lever that pivots on the support between a detent position and a release position, the detent lever retaining the fork bolt in the closed position when in the detent position and releasing the fork bolt for return to the open position when in the release position, the fork bolt being spring biased to the open position and the detent lever being spring biased to the detent position so that detent lever rides over an end of the fork bolt and engages a latch shoulder of the fork bolt when the fork bolt is moved to the closed position, a stop lever that pivots on the Support between a stop position and a by-pass position, the stop lever being spring biased to the stop position, an electric motor mounted on the support, a gear wheel that rotates on the support and that is driven by the electric motor, the gear wheel carrying an eccentric roller that moves in a circular path as the gear wheel rotates, the fork bolt moving the stop lever from the stop position to the by-pass position when the fork bolt is moved from the open position to the closed position so as to move a stop tab of the stop lever out of the path of travel of the roller, the roller bypassing the stop tab and moving the detent lever to the release position when the fork bolt is in the closed position and the motor is energized to power unlatch the closure latch, and the stop lever returning to the stop position when the closure latch is unlatched so that the stop is engaged by the roller to stall the motor.

3. A power operated vehicle compartment latch comprising:

a support that is adapted for fastening to a vehicle closure, a fork bolt that pivots about a first pivot pin of the support between an open position and a closed position, the fork bolt being moved from the open position to the closed position when the vehicle closure is closed and the fork bolt engages a striker that is attached to the vehicle at an opening for the vehicle closure, a detent lever that pivots about a second pivot pin of the support between a detent position and a release position, the detent lever retaining the fork bolt in the closed position when in the detent position and releasing the fork bolt for return to the open position when in the release position, the fork bolt being spring biased to the open position and the detent lever being spring biased to the detent position so that detent lever rides over an end of the fork bolt and engages a latch shoulder of the fork bolt when the fork bolt is moved to the closed position by closing the vehicle closure, a stop lever that pivots about the first pivot pin of the support between a stop position and a by-pass position, the stop lever being spring biased to the stop position, a unidirectional electric motor mounted on the support, a gear wheel that rotates on a third pivot pin of the support and that is driven by the unidirectional electric motor, the gear wheel carrying an eccentric roller that moves in a circular path as the gear wheel rotates on the third pivot pin to cooperate with the detent lever and the stop lever to unlatch the vehicle compartment latch, the fork bolt moving the stop lever from the stop position to the by-pass position when the fork bolt is moved from the open position to the closed position so as to move a stop tab of the stop lever out of the path of travel of the roller, the roller bypassing the stop tab and moving the detent lever to the release position when the fork bolt is in the closed position and the motor is energized to power unlatch the power operated vehicle compartment latch, and the stop lever returning to the stop position when the power operated vehicle compartment latch is unlatched so that the stop tab is engaged by the roller to stall the motor.

* * * * *